US008302540B1

(12) United States Patent
Niermeyer

(10) Patent No.: US 8,302,540 B1
(45) Date of Patent: Nov. 6, 2012

(54) EXTENDABLE FOLDING TABLE

(75) Inventor: Eric P. Niermeyer, Vestal, NY (US)

(73) Assignee: Stakmore Co., Inc., Owego, NY (US)

( * ) Notice: Subject to any disclaimer, the term of this patent is extended or adjusted under 35 U.S.C. 154(b) by 111 days.

(21) Appl. No.: 12/875,866

(22) Filed: Sep. 3, 2010

(51) Int. Cl.
*A47B 3/00* (2006.01)

(52) U.S. Cl. ..... 108/127; 108/87

(58) Field of Classification Search ..... 108/115, 108/127, 131–133, 83, 87, 89; 248/439, 248/188.6, 188, 188.1
See application file for complete search history.

(56) References Cited

U.S. PATENT DOCUMENTS

| | | | | | |
|---|---|---|---|---|---|
| 1,614,539 | A | * | 1/1927 | Ryan | 108/127 |
| 1,763,671 | A | * | 6/1930 | Rastetter | 108/127 |
| 1,776,346 | A | | 9/1930 | Buffington | |
| 1,879,945 | A | * | 9/1932 | O'Connor | 108/125 |
| 1,987,767 | A | * | 1/1935 | Beiger | 108/160 |
| 2,054,755 | A | * | 9/1936 | Kovats | 108/125 |
| 2,153,262 | A | * | 4/1939 | McFall | 108/63 |
| 2,271,332 | A | * | 1/1942 | Ellington | 403/65 |
| 2,308,256 | A | | 1/1943 | Wilkinson | |
| 2,432,266 | A | | 12/1947 | Wilkinson | |
| 2,602,717 | A | * | 7/1952 | Novick | 108/63 |
| 2,660,497 | A | * | 11/1953 | Norquist | 108/127 |
| 2,862,777 | A | * | 12/1958 | Paige | 108/34 |
| 2,984,859 | A | * | 5/1961 | Steiner | 16/291 |
| 3,096,732 | A | | 9/1963 | Wilkinson | |
| 3,362,357 | A | * | 1/1968 | Hoffert | 108/83 |
| 3,396,928 | A | * | 8/1968 | Lay | 248/188.6 |
| 3,964,403 | A | | 6/1976 | Schankman | |
| 4,041,880 | A | | 8/1977 | Schankman | |
| 6,000,345 | A | | 12/1999 | Gillotti | |
| 6,651,568 | B1 | * | 11/2003 | Buono | 108/127 |
| 2003/0172855 | A1 | * | 9/2003 | Wen | 108/125 |

* cited by examiner

*Primary Examiner* — Janet M Wilkens
(74) *Attorney, Agent, or Firm* — MacCord Mason PLLC

(57) ABSTRACT

An improved folding table includes an extension table having a pair of frame members, a top member, a pair of foldable legs, a slide, a corner bracket and a corner hinge. One top member is attached to one side of its frame member and the top members are stacked when the table is unextended. The legs are carried by each frame member and are located at a frame joint. The slide connects the frame members and includes a plurality of interlocking and movable members. The corner bracket and corner hinge are located at a frame joint and the corner hinge foldably connects the leg to the frame and bracket. The invention is also considered a corner bracket for use in an extension table having foldable legs and a frame with the corner bracket mountable at each frame joint and a method of making an extendable folding table.

9 Claims, 6 Drawing Sheets

EXTENDABLE FOLDING TABLE

FIELD OF THE INVENTION

The present invention relates generally to tables and, more particularly, to an improved system and method for extendable tables with folding legs.

BACKGROUND

Folding type tables, that is tables with folding legs that are extendable, are known in the art. Tables may have folding legs that detach from or fold against the table top. Tables may also have tops that fold or recess upon itself in order for the table top to decrease in size or extend to accommodate more people. Folding features allow a table to be used and stored and not take up as much space while in storage. Such features make folding tables versatile and mobile.

Hinged attachments may be used for folding the legs of a table while sliding mechanisms may be used for folding a table top where it recesses upon itself. Folding tables should be able to endure regular conversion from a folded to a deployed and back to a folded configuration. Constant conversion places stress and wear on the hinged and sliding areas of the table. The folding areas of the table may already be weak points in the table construction when the table is in use or undergoes a load. As a result, the hinged or sliding areas, where a table is often folded or recessed, need to have a strong structural integrity. Bulky, heavy or costly materials are often used in these areas to provide the needed strength.

Many of the existing folding tables may possess other disadvantages such as folding leaves, hinged tops and general instability due to the fact that the table legs do not support the outermost corners of the table when the table is extended.

For these, and other various reasons, Applicant believes that ease of mobility and versatility of folding tables is often hindered by the weight and bulkiness of the folding mechanisms and instability of the tables when extended.

Accordingly, there is a need in the art for a new method and apparatus that provides structural integrity to the folding and extendable portions of a folding table while not adding significantly to the cost or weight of the table or detracting from the versatility. It is to these and additional problems that this invention is directed.

SUMMARY OF THE INVENTION

The present invention fulfills one or more of these needs in the art by providing an economical apparatus and method for a folding table, which is sturdy, low in cost, and easy to operate but does not interfere with the mobility and versatility that makes folding tables desirable.

One aspect of the present invention is to provide an extension table with diagonally folding legs and support brackets, where the support brackets reinforce leg attachment points without hindering the functionality of the extendable folding table. The present invention therefore provides a folding leg extendable table which may be used as a conventional four place table when it is not extended, but which may be extended to provide a six-place table as required, and which, when so extended has the legs thereof at the outermost corners of the table. Locating the legs in this position provides for a maximum of stability together with the greatest possible seating space and leg room for the occupants or users of the table.

The folding table, when extended, offers substantially twice the top surface area of the table as compared with its contracted position. The table may be extended into its complete usable position by a single motion of the operator, and likewise, when the table is to be contracted, it is necessary only to raise one top section a distance sufficient to clear the other top section and push the two sections together, whereupon they automatically latch to provide a substantially square table of the type ordinarily used for card playing and similar purposes. The corner placement of the legs allows for the versatility found in the present invention but also may cause weakness in the attachment points of the hinge mechanism which connects the leg to the table corner. The corner brackets of the present invention provide stability to the attachment points of the legs. The corner placement and diagonal folding direction of the legs requires a hinge mechanism that will fold compactly under the table and may make it difficult to accommodate corner brackets and slide mechanisms for such extendable tables.

Accordingly, one aspect of the present invention includes a frame having a pair of frame members, a top member attached to each frame member, a pair of foldable legs, a slide, a corner bracket and a corner hinge. The top member is supported by and attached to each of the frame members. One top member is attached to one side of its frame member and the top members are arranged one above the other when the table is unextended. The pair of foldable legs are carried by each of the frame members and the legs are located at a frame joint. The slide seperably connects the frame members and includes a plurality of interlocking and relatively movable members. The corner bracket and corner hinge is located at a frame joint and the corner hinge foldably connects the leg to the frame and bracket.

The present invention may also be considered a corner bracket for use in an extension table having foldable legs and a frame. The corner bracket is mountable at each frame joint and includes a mounting face and an inside face. The mounting face is secured against a frame joint. A folding leg attaches to the frame through the inside face. The inside face includes a first side, a second side and a web. The first and second sides include an opening through which the bracket is attached to the frame, a hole through which the anchor bar attaches to the frame and an oblong hole through which the first bar engages with the frame. The web connects the first side and the second side.

The present invention may also be considered a method of making an extendable folding table including forming a top member having an upper surface and a bottom surface and attaching a frame with frame members along the bottom surface. The frame creates a volume under the top member. The method further includes connecting the frame members with a slide that has a plurality of interlocking and relatively movable members. A corner bracket is affixed in a frame joint located on each of the frame members. A corner hinge is secured to the table by attaching the corner hinge to the frame members through the corner bracket in the frame joint. The corner bracket has a first side and a second side attached to the frame and a web adjoining the first side and the second side. A leg is foldably connected to the frame members through the corner hinge. The leg is movable between an extended configuration and a folded configuration, wherein the leg provides a height to the table top in the extended configuration and the leg is collapsible diagonally into the volume under the top member when the leg is in the folded configuration.

These and other aspects of the present invention will become apparent to those skilled in the art after a reading of the following description of the preferred embodiment when considered with the drawings.

DESCRIPTION OF THE PREFERRED EMBODIMENTS

Figure 1:
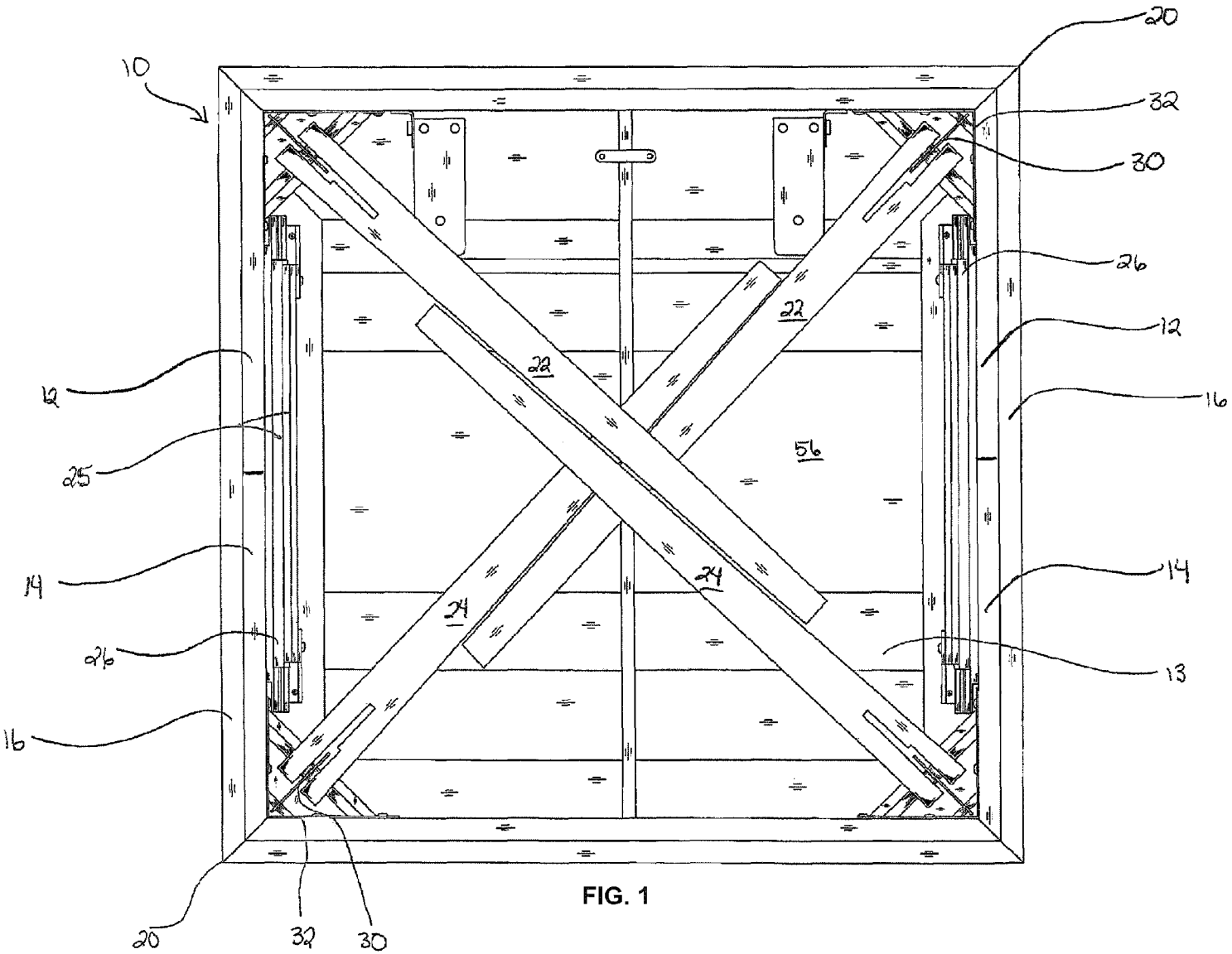
FIG. 1 shows a bottom view of an embodiment of the invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
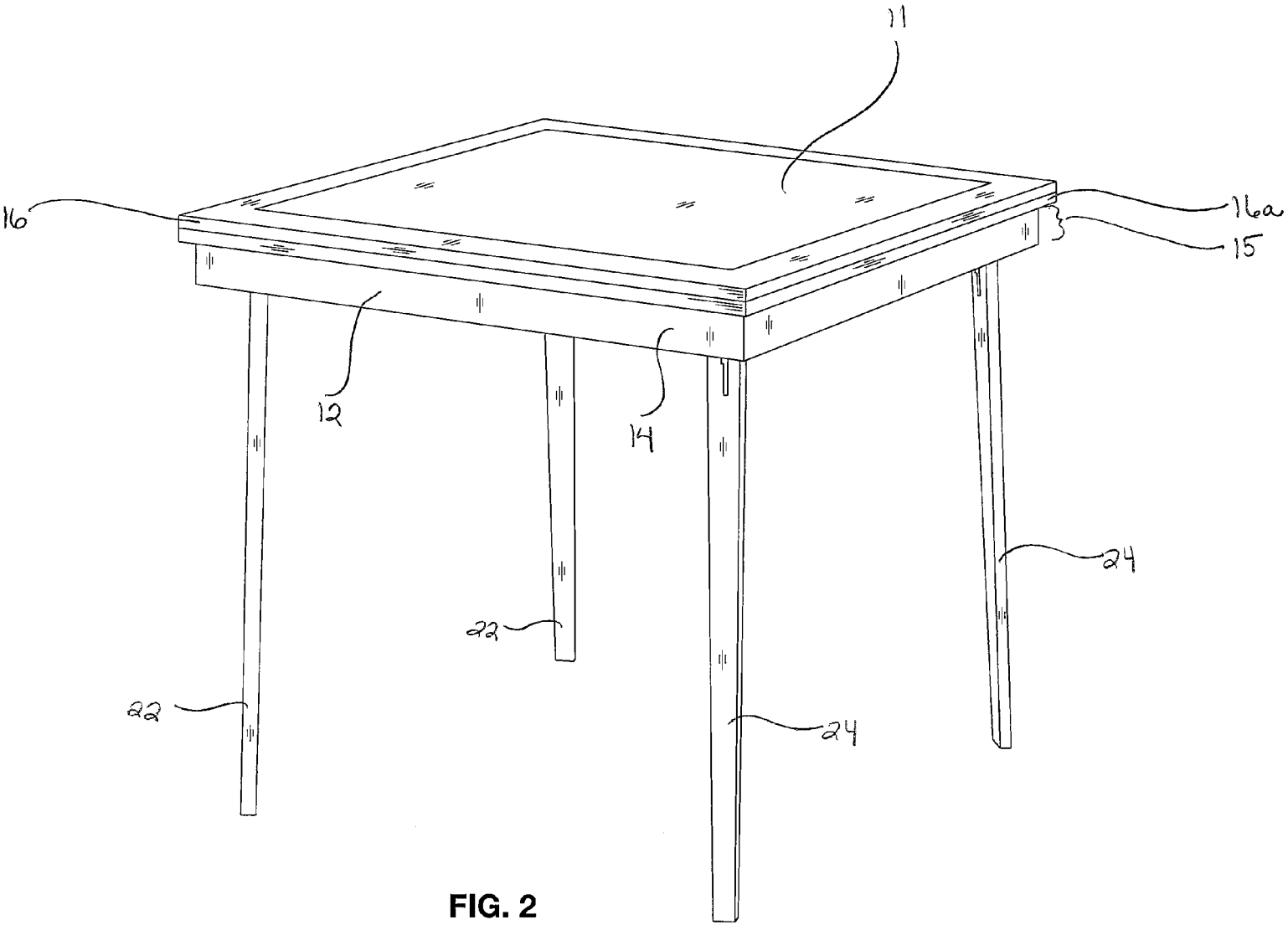
FIG. 2 shows a perspective view of the embodiment of FIG. 1.

It will be understood that the illustrations are for the purpose of describing a preferred embodiment of the invention and are not intended to limit the invention thereto. As best seen in FIGS. 1 and 2, an extension table, generally designated 10, is shown constructed according to the present invention. The table 10 includes a frame 15 having a pair of frame members 12 and 14, a top members 16 and 16*a* attached to each frame member, a pair of foldable legs 22 and 24, a slide 26, a corner bracket 32 and a corner hinge 30.

Frame members 12 and 14 are generally three-sided members which are extensibly connected by a slide 26. The slide seperably connects the frame members and includes a plurality of interlocking and relatively movable members 25. Each of the frame members 12 and 14 typically carries two foldable table legs 22 and 24, respectively. The legs 22 and 24 are preferably narrow so they will lie within the confines of volume 56 when they are folded, but may take on other shapes. In the folded position, legs 22 and 24 lie diagonally in the volume 56 across the underside of the table.

The top members 16 and 16*a* are supported by and attached to each of the frame members 12 and 14, respectively. Top member 16 is rigidly attached to its frame member 12 and top member 16*a* is attached to its frame member 14. The top members 16 and 16*a* are arranged one above the other when the table is not extended (top member 16*a* is not seen in FIG. 1). Additional rigidity of the top member 16 may be ensured by a pair of transversely extending bracing members (not shown) which are secured to the edges and underside of the top member 16 by any suitable means such as screws or by gluing. The remaining construction of top member 16 and 16*a* is conventional, and may be constructed and function as described in U.S. Pat. No. 2,308,256, which is herein incorporated by reference in its entirety.

The general construction of the slide 26 which permits the extension of the table to a predetermined distance is disclosed in U.S. Pat. No. 2,308,256. Generally, the slide has a connection member fixedly attached to the inner side of frame member 12, to frame member 14 and to braces located on the bottom surface 13 of top member 16, 16*a*. Two additional members 25 are moveable with respect to the connection members. The slide is shown in the extended position in FIG. 6 and in a mostly collapsed position in FIG. 5. Limit stops are provided to limit the distance which each member of this assembly can slide relative to the other member. The top surface of each slide element may be tapered slightly to ensure a snug fit of the top sections when the table is folded or unextended. This tapered slide construction also permits the two top members 16 and 16*a* of the table to lie perfectly flat in the same horizontal plane when the table is in its extended position. A slide as herein described is not per se new, but when used with a folding table with a corner hinge 30 and corner bracket 32 of the type herein described wherein one top member 16 overlies the other top member 16*a* when the table is folded, it is necessary for the slide to occupy minimal space and contribute nominal weight to the table.

A slide 26 preferably made of aluminum slide members 25 may provide a compact slide assembly which better handles the wear of extending and retracting the table repeatedly while reducing the weight of more traditional wood slides.

Figure 3:
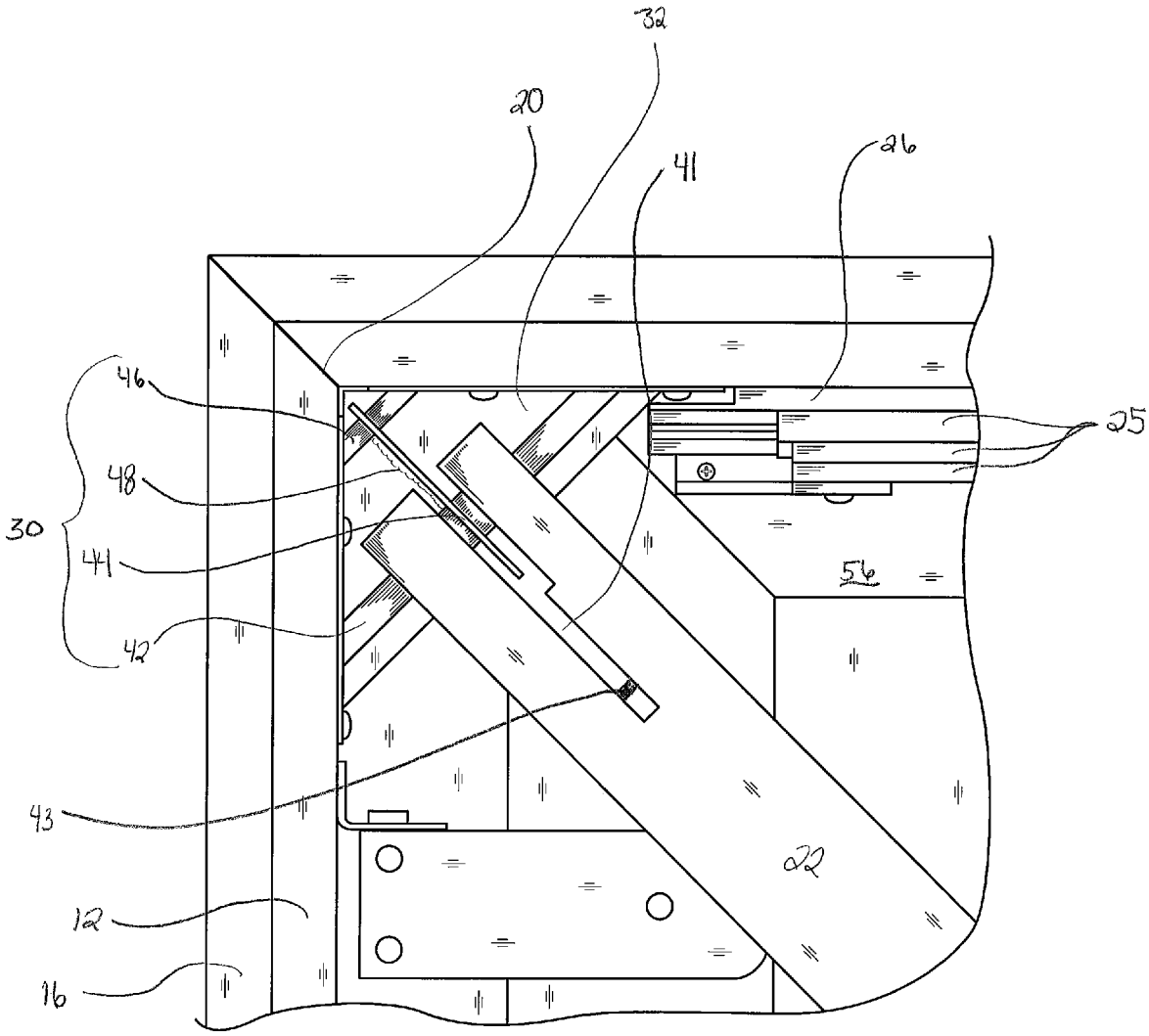
FIG. 3 shows an enlarged view of the corner joint of the embodiment of FIG. 1.

The pair of foldable legs 22 and 24, being carried by the frame members 12 and 14, respectively, are each attached foldably at a frame joint 20 by a corner hinge 30. The corner hinge 30 may include various hinge embodiments as disclosed in U.S. Pat. No. 2,308,256 and U.S. Pat. No. 2,432,266, which are herein incorporated by reference in their entireties. By way of example, the corner hinge 30 may, as can be seen in FIG. 3, include a first metal bar 42, a latch 44, an anchor bar 46 and a spring 48. Each leg 22 and 24 is pivotally mounted to the preferably metal first bar or hinge pin 42 that extends diagonally across the corner of the frame member and is supported by the frame including the bracket 32. The latch 44 is pivotally attached to the anchor bar 46 and to spring 48 which tends to bias latch 44 toward the table top. The outer end of latch 44, which may be notched, may be extended and engaged with a pin 43 located in the upper leg when the leg is unfolded and the table extended. When the leg is to be folded, the projecting end of latch 44 is released from engagement with the pin 43 and the leg is then folded inwardly across the table, and the latch itself, aided by the spring 48, assumes a substantially horizontal position with its outer end lying within the confines of slot 41.

The corner positioning and attachment of the legs 22 and 24 provide support for the table at its outermost corners, but, that positioning may also subject the legs, leg attachment, and corner hinge 30, to greater stresses. In tables made of long grain hardwoods, such as maple or oak, the frame may have enough strength to maintain the integrity of the corner hinge 30 in the frame 15 when subjected to usual forces. However, in shorter grain hardwoods, such as rubberwood, the grain of the wood may not provide as much inherent strength, and, a slighter outward force may result in the corner hinge 30 getting pulled away from the frame 15. In such an instance, the first bar 42 could pull through the frame 15.

Figure 4:
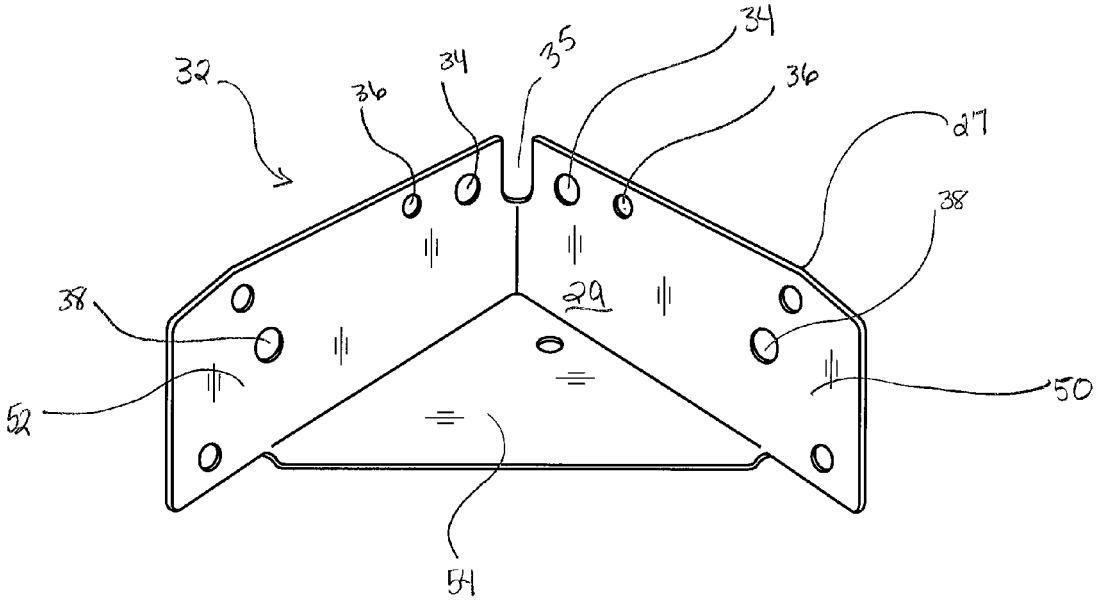
FIG. 4 shows a perspective view of an embodiment of the corner bracket.

Corner bracket 32, as seen in FIGS. 3 and 4, reinforces the frame joint 20, providing additional strength to the table itself, as well as securing the connection of the corner hinge 30 to the frame 15. The corner bracket accommodates the structure of the frame 15, as well as the structure of the corner hinge 30 without interfering when the legs 22 and 24 collapse into volume 56, in part because of a notch 35 at the apex of the first and second sides.

Accordingly, the present invention may also be considered a preferably metal corner bracket 32 for use in an extension table having foldable legs 22 and 24 and a frame 15. The corner bracket 32 is mountable at each frame joint 20 and includes a mounting face 27 and an inside face 29. The mounting face 27 is secured against a frame joint 20. By way of example, mounting face 27 may be secured by screws or nails. A folding leg attaches to a corner hinge 30, which in turn, attaches to the frame 15 through the inside face 29.

The inside face includes a first side 50, a second side 52 and a web 54. The first and second sides 50 and 52 each include an opening 36 through which the bracket 32 is attached to the frame 15, a hole 34 through which the anchor bar attaches to the frame and an oblong hole 38 through which the first bar engages with the frame. The web 54 connects and strengthens the first side 50 and the second side 52. The oblong hole 38 may accommodate the diagonal angle of first bar 42 and provides a longer point of attachment for first bar 42 as it passes into the frame 15, strengthening the integrity of the attachment, so that outward forces are less likely to dislocate the corner hinge 30 from the frame 15. Hole 34 may be cut at an angle to accommodate the diagonal insertion of the anchor bar 46 into the frame 15. Holes 34 and 38 create a width that assists the frame in supporting the attachment of the corner hinge 30. The holes being cut at approximately an angle of between 40 and 50 degrees allows the width to better support the hinge attachment bars 42 and 46 as they pass through the bracket 32 and into the frame 15.

Additionally, the presence of the bracket 32 allows for replacement of a broken leg in the table without disassembling the table, as is the practice without the bracket of the current invention. In the event of a broken table leg, a consumer is not usually able to replace the broken leg without considerable skill. With the bracket 32 in place, a broken leg can be replaced by unattaching the bracket from the corner, removing the broken leg and inserting a new leg into the bracket and then reattaching the corner bracket-leg assembly into the corner of the table.

Figure 6:
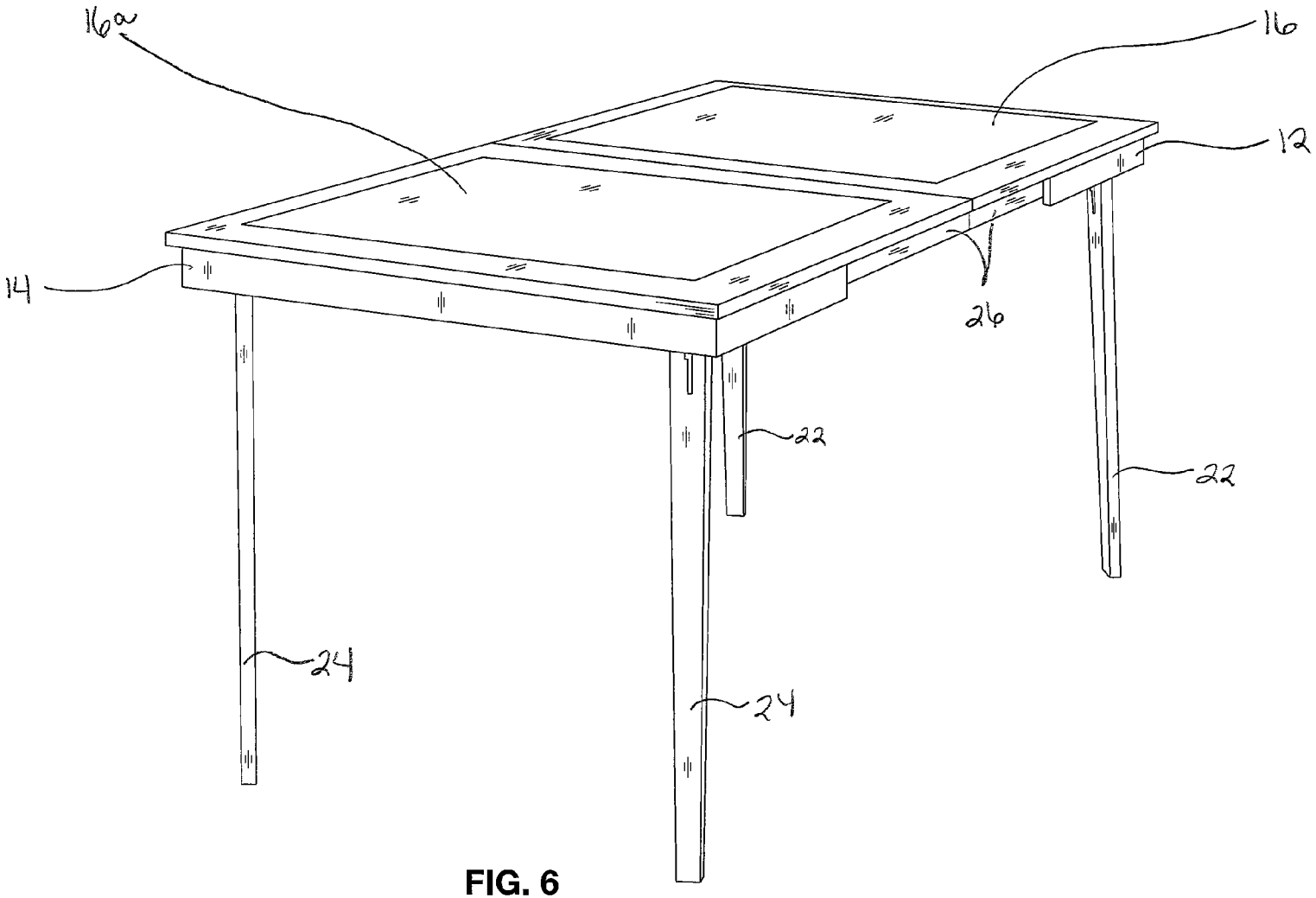
FIG. 6 shows a perspective view of one embodiment of the folding table of FIG. 1 fully expanded.

The present invention may also be considered a method of making an extendable folding table including forming a top member 16 and 16*a* having an upper surface 11 and a bottom surface 13 and attaching a frame 15 with frame members 12 and 14 along the bottom surface 13. The frame 15 creates a volume 56 under the top members 16 and 16*a*. The method further includes connecting the frame members 12 and 14 with a slide 26 that has a plurality of interlocking and relatively movable members 25. A corner bracket 32 is affixed in a frame joint 20 located on each of the frame members 12 and 14. A corner hinge 30 is secured to the table by attaching the corner hinge to the frame members 12 and 14 through the corner bracket 32 in the frame joint 20. The corner bracket 32 has a first side 50 and a second side 52 that both attach to the frame 15 and a web 54 adjoining the first side and the second side. Leg 22 and 24 are foldably connected to the frame members 12 and 14, respectively, through the corner hinge 30. The leg is movable between an extended configuration, as seen in FIGS. 2 and 6, and a folded configuration, as seen in FIG. 1, wherein the legs 22 and 24 provide a height to the table top in the extended configuration and the legs are collapsible diagonally into the volume 56 under the top members 16, 16*a* when the legs are in the folded configuration.

Figure 5:
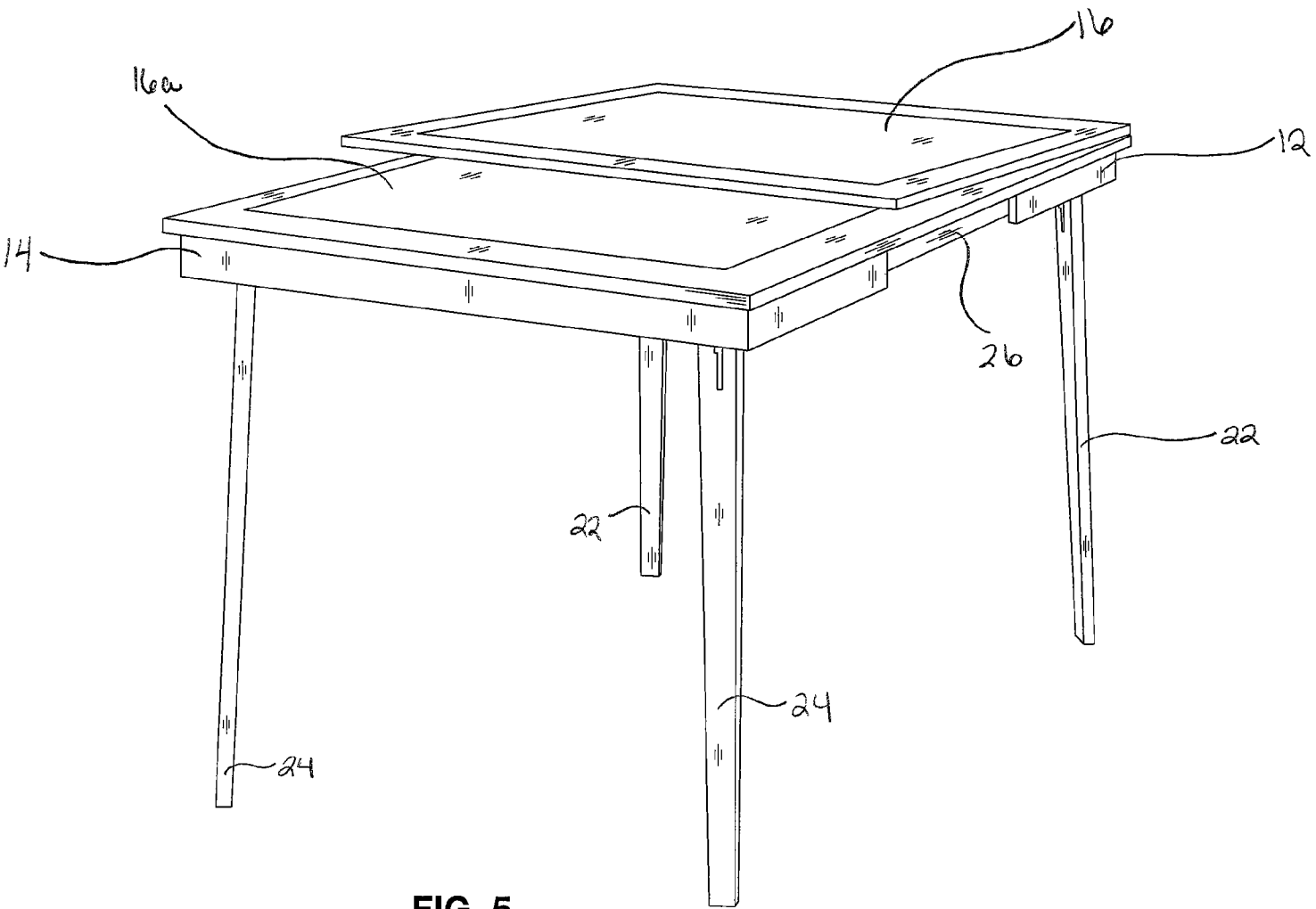
FIG. 5 shows a perspective view of one embodiment of the extendable folding table of FIG. 1 partially expanded.

In operation, and by way of example, assuming the table to be in the collapsed position shown in FIG. 1, with the top member 16 overlying the top member 16*a*, and the latch 44, in the spring biased position, the table legs 22 and 24 are first unfolded so that they are substantially perpendicular to the top members. The table is then stood on its four legs and the latch members 44 engaged with pin 43. The table may then be extended, as seen in FIG. 5, by drawing the frame member 12 and its attached top section 16 and legs 22 away from the frame 14 and its top member 16*a* and legs 24. When the top member 16*a* is completely withdrawn from beneath the top member 16, the latter section, because of the slide construction, drops into horizontal alignment with the top member 16*a* and is locked in place. It will then be seen that when the table is extended as shown in FIG. 6, the four legs are disposed at the four outer corners of the table, thus ensuring the greatest possible stability and providing maximum leg room for the users.

To collapse the table, it is merely necessary to raise the top member 16 and push the two top members 16 and 16*a* toward each other. When the table is thus collapsed it affords a substantially square table of the type used for card-playing and similar purposes. When the table legs 22 and 24 are folded in, the table is ready for storage, occupying but slightly more room than the conventional folding non-extensible card table.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. An extension table comprising:

a frame having a pair of frame members, a top member supported by and attached to each of the frame members, one top member being attached to one side of its frame member, the top members lying one above the other when the table is unextended, a pair of foldable legs carried by each of the frame members wherein the legs are located at a frame joint, a slide separably connecting the frame members, the slide comprising a plurality of interlocking and relatively movable members, the foldable legs being movable with each frame member to which they are attached, whereby the legs support the table at its outermost corners when the table is extended, a metal corner bracket located at the frame joint of each frame member, the bracket including two flanges at right angles to each other to mount against inside intersecting members of the frame members and a web connecting the two flanges in a plane perpendicular to each flange to mount against the top member, with aligned holes in each of the flanges, and a corner hinge located at the frame joint including a hinge pin extending from one hole to the other hole in the corner bracket and foldably connecting the leg to the frame and bracket.

2. The table of claim 1 wherein the top member and frame members are made of a hardwood of a grain length approximating the grain length of rubberwood.

3. The table of claim 1 wherein the corner hinge includes the hinge pin, an anchor bar, a spring, and a latch.

4. The table of claim 3 wherein the corner bracket includes a first side, a second side and the web.

5. The table of claim 4 wherein the first side and the second side each include an opening through which the bracket is attached to the frame member, a hole through which the anchor bar attaches to the frame member and an oblong hole through which the hinge pin engages with the frame.

6. The table of claim 1 wherein the slide includes movable members that are made of aluminum.

7. A method of making an extendable folding table comprising:

forming a top member having an upper surface and a bottom surface, attaching a frame having frame members along the bottom surface, the frame creating a volume under the top member, connecting the frame members with a slide having a plurality of interlocking and relatively movable members, affixing a corner bracket in a frame joint located on each of the frame members, the bracket including two flanges at right angles to each other so that affixing the corner bracket mounts each flange against one of the members and a web connecting the two flanges in a plane perpendicular to each flange so affixing the bracket mounts the web against the top member, and securing a corner hinge to the table by attaching a corner hinge pin to the frame members through aligned holes in each of the flanges of the corner bracket in the frame joint, wherein the corner bracket has a first side and a second side attached to the frame and the web adjoining the first side and the second side, and foldably connecting a leg to the frame members through the corner hinge, the leg being movable between an extended configuration and a folded configuration, wherein the leg provides a height to the table top in the extended configuration and wherein the leg is collapsible diagonally into the volume under the top member when the leg is in the folded configuration.

8. The method of making an extendable folding table of claim 7 wherein affixing the corner bracket includes aligning oblong holes in the first side and the second side with openings in the side frames and attaching the hinge pin to the frame through the oblong holes and the openings in the side frames.

9. The method of making an extendable folding table of claim 7 further including offsetting the foldably connected legs so that the legs attached in opposing frame joints fold substantially diagonally into the volume adjacent to one another.

* * * * *